US005775194A

United States Patent [19]

Spada

[11] Patent Number: 5,775,194

[45] Date of Patent: Jul. 7, 1998

[54] DEVICE FOR MAKING CUTS IN THE DIRECTION OF THE ADVANCE OF PIECES OF THIN MATERIAL

[75] Inventor: Valter Spada, Marzabotto, Italy

[73] Assignee: SASIB S.p.A., Bologna, Italy

[21] Appl. No.: 594,921

[22] Filed: Jan. 31, 1996

[30] Foreign Application Priority Data

Feb. 9, 1998 [IT] Italy ..... GE95A0012

[51] Int. Cl.[6] ..... B26D 7/26

[52] U.S. Cl. ..... 83/698.31; 83/698.41; 83/332; 493/371

[58] Field of Search ..... 83/663, 676, 678, 83/698.31, 698.41, 698.42, 332, 674, 346; 493/368, 366, 371, 370, 60, 365

[56] References Cited

U.S. PATENT DOCUMENTS

| | | | |
|---|---|---|---|
| 461,600 | 10/1891 | West | 83/348 |
| 2,815,077 | 12/1957 | Pechy | 83/500 X |
| 2,870,840 | 1/1959 | Kwitek | 83/678 X |
| 3,209,633 | 10/1965 | Doerman | 83/346 |
| 3,709,077 | 1/1973 | Trogan et al. | 83/345 X |
| 3,828,637 | 8/1974 | Slack | 83/674 X |
| 4,004,479 | 1/1977 | Bodnar | 83/347 X |
| 4,010,666 | 3/1977 | Masters | 83/678 |
| 4,240,313 | 12/1980 | Gillespie | 83/346 X |
| 4,254,680 | 3/1981 | Gauthier | 83/698.41 X |
| 4,366,737 | 1/1983 | Bedford | 83/346 X |
| 4,370,908 | 2/1983 | DeAlto et al. | 83/348 |
| 4,444,080 | 4/1984 | Schulz | 83/346 X |
| 4,485,710 | 12/1984 | Schilsio et al. | 83/346 |
| 4,502,357 | 3/1985 | Hussissian | 83/332 |
| 4,537,104 | 8/1985 | Dealto et al. | 83/346 X |
| 4,615,671 | 10/1986 | Bernal | 83/332 X |
| 4,640,165 | 2/1987 | McMahon et al. | 83/346 |
| 4,643,060 | 2/1987 | Fremion | 83/332 X |
| 4,709,607 | 12/1987 | Buhayar | 83/347 X |
| 4,785,697 | 11/1988 | Gherardi | 83/698.51 X |
| 4,785,832 | 11/1988 | Gherardi et al. | 83/348 X |
| 4,932,298 | 6/1990 | Capdebosco | 493/368 X |
| 4,962,683 | 10/1990 | Scheffer et al. | 83/346 X |
| 5,086,683 | 2/1992 | Steidinger | 83/674 |
| 5,109,741 | 5/1992 | Fuchs | 83/346 X |
| 5,144,874 | 9/1992 | Garrett | 83/332 |
| 5,174,184 | 12/1992 | Meeks | 83/332 |
| 5,224,408 | 7/1993 | Steidinger | 83/674 |
| 5,461,841 | 10/1995 | Spada et al. | 53/234 |

FOREIGN PATENT DOCUMENTS

| | | |
|---|---|---|
| 515364 | 11/1952 | Belgium . |
| 0249011 | 12/1987 | European Pat. Off. . |
| 0334439 | 3/1989 | European Pat. Off. . |
| 614811 | 9/1994 | European Pat. Off. . |
| 726126 | 8/1996 | European Pat. Off. . |
| 1074392 | 1/1960 | Germany . |
| 3738196 | 5/1989 | Germany . |
| 172158 | 12/1921 | United Kingdom . |
| 997736 | 7/1965 | United Kingdom . |
| 1048301 | 11/1966 | United Kingdom . |
| 1332427 | 10/1973 | United Kingdom . |

*Primary Examiner*—Rinaldi I. Rada
*Assistant Examiner*—Elizabeth Stanley
*Attorney, Agent, or Firm*—Larson & Taylor

[57] ABSTRACT

A device for making cuts in the direction of the advance of pieces of thin material, for example in slips of paper along the path on which they are fed, includes a cutter carrying drum (1) and a cutting bed drum (2) rotating in opposite directions to each other. The drum (1) carries at least one peripheral cutter (3, 3', 3") whose cutting edge (103) is orientated in the direction of advance of the pieces of material and is curved coaxially with the drum (1), projecting radially beyond it. The cutter (3, 3', 3") is fixed on the cutter carrying drum (1) by a removable (5, 7) base (4, 4', 4") which has an intrinsic elasticity provided by slits such that it provides a certain spring support of the cutter (3, 3', 3") alternatively and in combination in the radial direction and in the direction of oscillation about an axis transverse to the cutting edge (103) of the cutter (3, 3', 3"), in particular substantially parallel to the axis of the drum (1).

19 Claims, 2 Drawing Sheets

DEVICE FOR MAKING CUTS IN THE DIRECTION OF THE ADVANCE OF PIECES OF THIN MATERIAL

BACKGROUND AND SUMMARY OF THE INVENTION

The invention relates to a device for making cuts in the direction of the advance of pieces of thin material, for example for making cuts in pieces of paper or similar material, possibly detached from a continuous strip, and along the path on which the pieces are fed to a subsequent processing machine, the device comprising at least one cutter carrying drum which is rotatable in the direction of advance of the pieces of material and which carries at least one peripheral cutter, whose cutting edge is orientated in the circumferential direction and is curved coaxially with the axis of the drum, projecting radially beyond the periphery of the drum, while the cutter carrying drum interacts with a parallel cutting bed drum which is also rotatable, the pieces of material being made to pass between the cutter carrying drum and the cutting bed drum to make a predetermined cutting and/or breaking or tearing line in the direction of advance of the piece of material between the two drums.

Devices of the type indicated above are used in particular in the tobacco product processing industry, in particular for packing cigarettes in what are known as rigid packs with hinged lids. In this case, the cigarettes, in the form of an ordered group, are also completely wrapped in an inner wrapping of the pack. This inner wrapping is formed from a tinfoil slip. The rigid pack with a hinged lid is made in such a way that when the lid is opened an aperture is revealed at the upper end of the front face of the pack, through which it is possible to take hold of the cigarettes. For this purpose it is necessary to remove the part of the inner wrapping coinciding with the aperture. This is made possible by making in the tinfoil slip, along the path on which it is fed to the packing machine, a predetermined breaking line substantially corresponding to the shape of the aperture and consisting of a series of successive cuts aligned to correspond to a predetermined profile and separated by links of material formed by uncut areas. Part of the predetermined breaking line is orientated in the direction of advance of the tinfoil slip in the path on which it is fed to the packing machine.

At the present time there are known cutters of the type mentioned above, in which the circumferential cutter is mounted rigidly on the cutter carrying drum. This is disadvantageous, since when the cutter and the cutting bed always interact substantially at one point the cutting edge of the cutter is worn down very rapidly. Furthermore, since the wear of the cutting edge of the cutter depends on the adjustment of the force with which the cutter is pressed against the cutting bed drum, this adjustment is difficult and is subject to the level of skill of the operating personnel, in other words to chance factors.

The object of the invention is to provide a device of the type described initially which enables the disadvantages of the known cutters to be avoided, making the adjustment operations easier and ensuring optimal adjustment within the predetermined tolerances and consequently a longer life and better results in operation.

The invention achieves the above objects with a device of the type described initially, in which at least one circumferential cutter is fixed on the cutter carrying drum by means of a cutter mounting base which is fitted removably on the drum and which has an intrinsic elasticity such that it provides a sprung support of the cutter alternatively and in combination in the radial direction and in the direction of oscillation about an axis transverse to the cutting edge of the cutter, in particular substantially parallel to the axis of the drum.

The axis of oscillation passes substantially through a median area of the total extension of the cutter and of the associated cutter mounting base both in the radial direction and in the circumferential direction, preferably through a median area of the cutter mounting base.

According to a preferred embodiment, the intrinsic elasticity of the cutter mounting base is obtained by means of at least two rows of thin slits which are formed in the cutter mounting base and which are orientated parallel to each other and spaced apart in the radial direction. The slits are rectilinear and orientated along the tangent to the substantially median point of the arc formed by the cutting edge of the cutter.

The slits of at least one row terminate at a certain distance from each other in the median area of the cutter mounting base and are open at the associated radial edges of the base, while the slits of at least one further row are closed at both ends.

Each cutter mounting base may advantageously have three rows of slits, each of two of which consists of a single slit which is closed at both ends, while the third row of slits is interposed between the first two rows and consists of two slits aligned with each other and with their opposing inner ends spaced apart, while they extend to the corresponding radial edges of the cutter mounting base at which edges they are open.

This configuration of the slits forms an elastic support portion, which provides a spring support of the cutter alternatively and simultaneously in oscillation about an axis substantially parallel to the axis of the drum and passing through the area interposed between the two intermediate slits, and in the radial direction.

For the execution of a plurality of cuts to make a predetermined breaking or tearing line, the invention provides that the cutter is to be formed from a plurality of cutters of lesser length, aligned in sequence along the cutting line, each of which is supported by an intrinsically elastic cutter mounting base.

The individual cutter mounting bases may be combined all together or in groups on a single base for fixing to the drum.

According to a further advantageous characteristic, in order to prevent the cutting of intermediate areas between the individual cuts as a result of the progressive wear of the cutter, which would form a continuous cut or make excessively weak connecting areas between the cuts, the individual cutters are made to be disposed so that they are spaced apart from each other by interstices in the circumferential direction. The angular size of the spacing interstices corresponds substantially to that of the links of material left between the cuts for the formation of the predetermined breaking and tearing line.

In combination with the above, and to avoid the necessity of fitting an excessive number of cutters in order to obtain a predetermined breaking and tearing line of the desired length and with a sufficient number of links of material, provision is made, in combination with the angular spacing of the individual cutters, for the formation of notches or small recesses in the cutting edges of at least some of the cutters, in a way generally known for the formation of the links of material, the position of these notches being possibly determined with reference to the spacing interstices between the individual cutters in such a way as to obtain a predetermined distribution of the links of material, preferably an equally spaced positioning of the links.

The invention also relates to other characteristics which further improve the device described above and which form the subject of the dependent claims.

BRIEF DESCRIPTION OF THE DRAWINGS

The particular characteristics of the invention, and the advantages derived therefrom, will be more clearly understood from the description of some preferred embodiments, illustrated by way of example and without restriction in the attached drawings, in which.

BRIEF DESCRIPTION OF THE PREFERRED EMBODIMENT OF THE INVENTION

Figure 1:
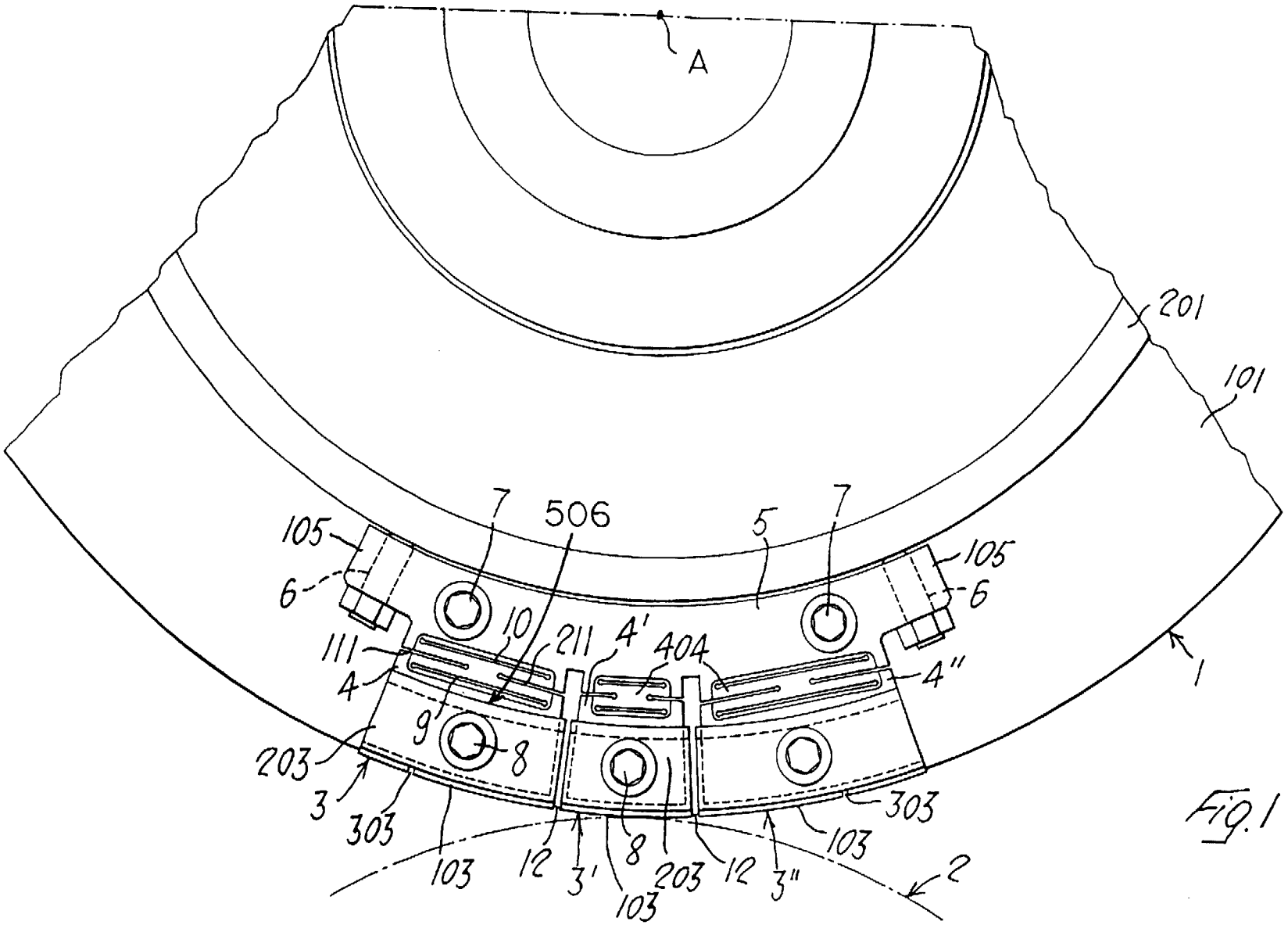
FIG. 1 is a partial view in the direction of the axis of a cutter carrying drum, with a cutter according to the invention.

With reference to the figures, a device for making cuts in pieces of material, such as slips, cards, or similar, cut from a strip and made to advance from an unwinding station through the cutting station to a subsequent station for feeding to a further processing machine of any kind, for example a cigarette packing machine, comprises a cutter carrying drum 1 and an interacting cutting bed drum 2. The two drums 1, 2 are mounted rotatably about their axes which are orientated parallel to each other and to the surface of the piece of material (not illustrated) which is made to pass between them. The two drums 1, 2 are disposed in such a way that the cutting edge 103 of the peripheral cutter or cutters 3, 3', 3" carried by the cutter carrying drum 1 bear on the periphery of the cutting bed drum 2 with a certain pressure. The cutting bed drum 2 may be made in any way and in particular has a completely cylindrical peripheral surface which may also incorporate suction devices.

The peripheral cutter or cutters 3, 3', 3" are disposed with their cutting edges 103 orientated in the direction of advance of the piece to be cut, in other words tangentially or circumferentially with respect to the cutter carrying drum 1.

Three peripheral cutters 3, 3', 3", which are aligned with each other in the same plane transverse with respect to the axis A of the drum 1, and each of which is fitted on a cutter mounting base or portion 4, 4', 4", are supported on the cutter carrying drum 1. The cutter mounting bases 4, 4', 4" are fixed to and/or as shown made integrally with a common fixing base or portions 5 for fixing to the cutter carrying drum 1. The fixing base 5 is shaped in the form of a bridge or curved bar. The curved shape preferably corresponds to that of a sector coaxial with the cutter carrying drum 1, and in particular to that of a peripheral ridge 201. This is circular and coaxial with the cutter carrying drum 1, has a radius smaller than that of the peripheral curved surface of the cutter carrying drum 1, and constitutes the radially inner base wall of a peripheral recess, cavity or groove 101 of the drum 1 in which the fixing base 5 with the cutter mounting bases 4, 4', 4" is housed. In particular, the radial extension of the recess, cavity or groove 101 is such that the fixing base 5 and the associated cutter mounting bases 4, 4', 4" terminate with their peripheral edge radially inset with respect to the peripheral surface of the cutter carrying drum 1, while the cutters 3, 3', 3" project radially beyond the peripheral curved surface with their cutting edges 103.

At its circumferential ends or end areas, the fixing base 5 has two fixing extensions 105 into which are screwed radial threaded pins 6 for the adjustment of the radial position of the fixing base 5. The fixing base 5 bears on the axial ridge 201 only in the area of the adjusting pins 6. The fixing base 5 is locked to the cutter carrying drum 1 by an attaching means comprising axial screws 7 which engage, through apertures 205 made at least in the areas of the opposing circumferential ends of the fixing base 5, in coinciding axial threaded holes in the lateral wall or facing surface of the recess 101. The recess 101 may therefore advantageously have a lateral wall which is open or at least openable, at least in the area of the screws 7. The apertures 205 in the fixing base 5 have at least one diameter slightly greater than the diameter of the screws or are made slightly elongate in the radial direction of the cutter carrying drum 1, in such a way as to permit the adjustment of the radial positioning of the fixing base 5 by an adjustment means comprised of the pins 6.

The peripheral edges of the cutter mounting bases 4, 4', 4" and the cutting edges 103 of the peripheral cutters 3, 3', 3" may advantageously be made curved, in particular in the form of sectors coaxial with the cutter carrying drum 1. The cutter mounting bases 4, 4', 4" have in their radially outer portions 104 a shape slightly smaller than the fixing ends 203 of the cutters 3, 3', 3". The radially outer portions 104 are made in the form of plates on which the inner fixing ends 203 of the corresponding cutters 3, 3', 3" are axially superimposed, these ends also being in the form of plates, at least both of the contact planes being disposed perpendicularly to the axis A of rotation of the cutter carrying drum 1. The cutters 3, 3', 3" are fixed to the radially outer portions 104 of the cutter mounting bases 4, 4', 4" by means of axial screws 8 which are engaged, through apertures in the fixing ends 203 of the cutters 3, 3', 3", in coinciding holes 304 in the cutter mounting bases. As illustrated, the fixing of each cutter 3, 3', 3" to the associated cutter mounting base 4, 4', 4" requires only a single median axial screw 8 to lock these parts together.

Figure 2:
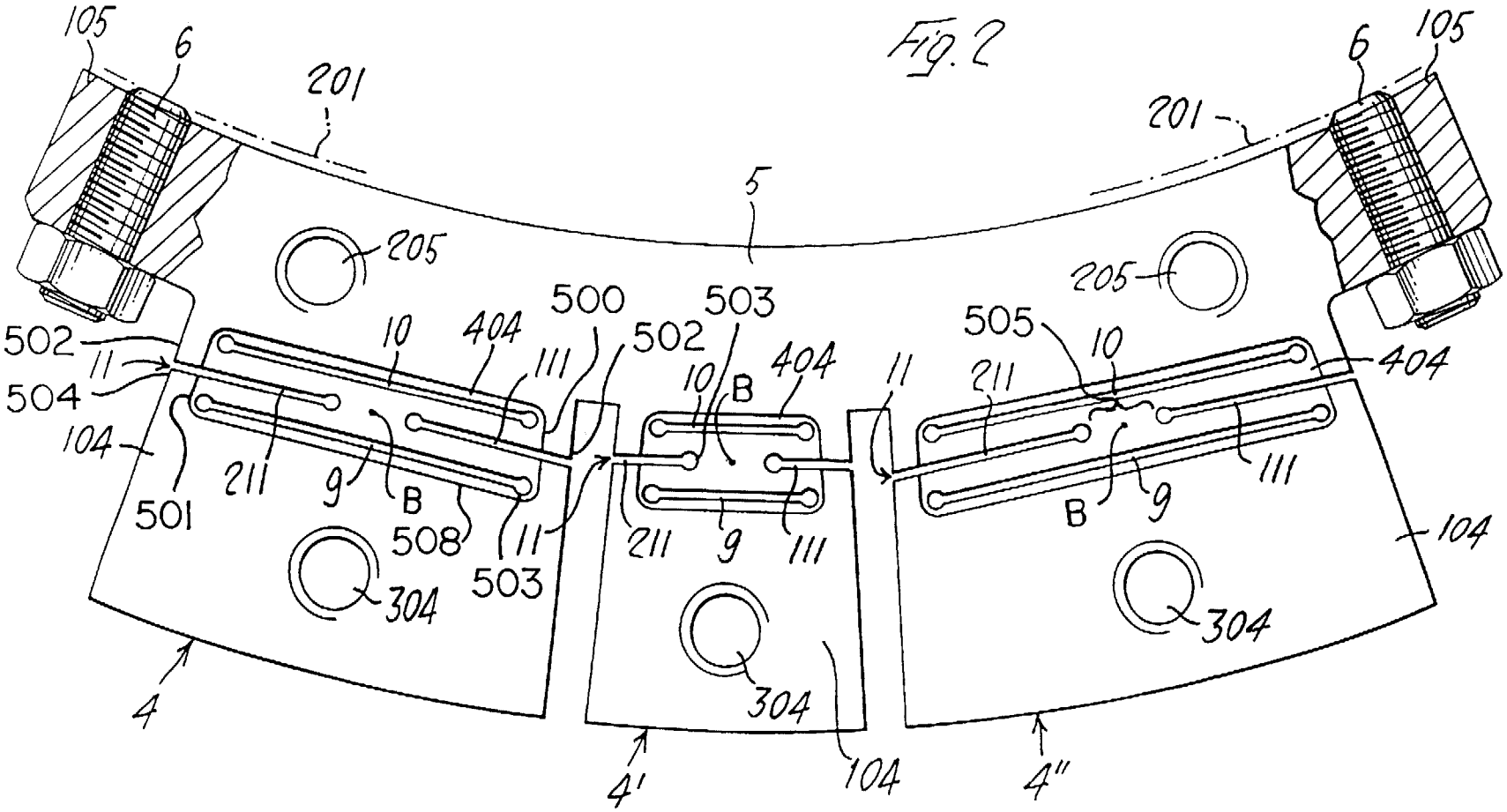
FIG. 2 is a side view, on an enlarged scale, of a fixing base for a cutter according to the invention, in which three cutter mounting bases are combined.

In a radially inner position with respect to the inner radial edge 506 of each peripheral cutter 3, 3', 3", in other words of each fixing end 203 of the cutters, each cutter mounting base 4, 4', 4" has a recess or elastic support portion 404, next to which three rows of first, second and third slits 9, 10, 11 are provided. The rows of slits 9, 10, 11 and the slits themselves are preferably rectilinear and are orientated parallel to the tangent to the corresponding cutters 3, 3', 3" at their median points. The rows of slits 9, 10, 11 are equidistant from each other in the radial direction. According to a preferred configuration, a single slit 10, 9 respectively is provided in each of the radially inner and outer positions 507, 508 and extends from a first lateral side 500 to a second lateral side 501, respectively, of the elastic support portion 404. In an intermediate position between the continuous slits 9, 10, the row of slits 11 consists of two slits 111, 211 aligned with each other and terminating with their closed ends 503 facing each other and at a certain distance from each other. The opposite ends 502 of the slits 111, 211 extend beyond the side 504 of the elastic support portion 404 and up to the corresponding edge on the circumferential end of the corresponding cutter mounting base 4, 4', 4", at which ends the slits 111, 211 are open. The closed ends 053 of the slits 9, 10, 111, 211 are made with a greater width than that of the remaining parts of the slits 9, 10, 111, 211. Additionally, as shown in particularly in FIG. 2, depending on the dimensions of the cutter 3, 3', 3", the length of the intermediate portion 505 between the two median slits 111, 211 is markedly less than that of the continuous slits 9, 10 with a maximum length substantially equal to half of the length of the continuous slits 9, 10, while the intermediate slits 111, 211 have a minimum length which is of the order of magnitude of the intermediate portion 505 or, preferably and if compatible with the dimensions of the cutter 3, 3', 3", a length markedly greater than that of the intermediate portion between the slits 111, 211. The total length of the intermediate slits 111, 211 may also be substantially equal to or of the order of magnitude of the length of the continuous slits 9, 10 or greater than this, while the two continuous slits 9, 10 have lengths of substantially the same order of magnitude. In particular, the elastic support portion 404 has a substantially trapezoidal and isosceles shape and is disposed with the common fixing base 5 facing the axis A of the cutter carrying drum 1, while the radially outer continuous slit 9 is correspondingly longer than the radially inner continuous slit 10. The cutter mounting bases 4, 4', 4" may advantageously be made, at least in the area of the elastic support portion 404 404, preferably completely of steel with high elasticity, known as spring steel. To avoid reciprocal interference, the cutter mounting bases 4, 4', 4" are also disposed at a distance from each other and therefore constitute a sort of external ring of plate-shaped elements substantially in the form of coaxial sectors at a distance from each other, originating from the fixing base 5.

By means of the above construction, the cutters 3, 3', 3" are supported in an elastically yielding way alternatively and/or in combination in relation to radial displacement and in relation to oscillation about an axis B parallel to the axis A of the cutter carrying drum 1, in other words perpendicular to the cutting edge 103. The axis B of oscillation passes approximately through a radially and circumferentially median area of the total extension of the cutter and of the associated cutter mounting base both in the radial direction and in the circumferential direction, preferably through a median area of the group formed by the cutter 3, 3', 3", the associated cutter mounting base 4, 4', 4", and the fixing base 5, this area advantageously coinciding, for each cutter 3, 3', 3", with the area of the intermediate portion separating the intermediate slits 111, 211 of the associated cutter mounting base 4, 4', 4". Therefore, when the initial or terminal area of the cutting edge 103 of the cutter 3, 3', 3" interacts with the cutting bed drum 2, the associated cutter mounting base 4, 4', 4" yields elastically principally in an oscillation into the inclined position of the cutting edge 103 with respect to the tangent to the point of contact with the cutting bed drum 2, while, as the contact point of the cutting edge 103 against the counter cutter 2 moves into an intermediate area of the cutting edge 103, the cutter mounting base 4, 4', 4" yields elastically increasingly principally in the radial direction of the cutter carrying drum 1. In this way it is possible to make the cutting edges 103 of the cutters 3, 3', 3" come into contact with the cutting bed drum 2 always at one point only and with a predetermined pressure which is regulated within the permitted tolerances, ensuring a maximum precision of cut and a minimum wear of the cutting edge 103.

When a plurality of peripheral cutters 3, 3', 3" is provided, each with an associated cutter mounting base 4, 4', 4", the axes B of oscillation of the different cutters 3, 3', 3" are made to be substantially all at the same radial distance from the axis A of the drum.

The device according to the illustrated embodiment is particularly suitable for making predetermined tearing or breaking lines formed by individual cuts of predetermined length which are disposed along the profile of the predetermined breaking or tearing line and which are separated from each other by uncut areas forming links of material. This may be achieved by providing, in the cutting edges 103 of the cutters 3, 3', 3", radial notches or indentations 303 whose depth is such that the piece of material is not cut where it is next to these notches.

According to an improvement of the invention, in order to prevent the notches 303 from becoming insufficiently deep as a result of the progressive wear of the cutting edges 103, thus causing the material to be incised, cut or weakened where it is next to the notches or causing the links of material to become too weak, the separate cutter 3, 3', 3" consists of three cutters aligned with each other in sequence along the desired cutting line and spaced apart in such a way as to form interstices 12 next to which the material is not incised or in any case does not come into contact with any cutter. Sufficiently strong links of material will therefore always be formed next to these areas between the adjacent cuts of the cutters 3, 3', 3".

To avoid the provision of a considerable number of individual cutters 3, 3', 3" combined all together or in sub-groups on common fixing bases 5 similar to those described previously, or to prevent the cutters from becoming too small with respect to their angular size, it has proved advantageous to also provide notches 303 in the cutting edges of the cutters 3, 3', 3", in combination with a cutter consisting of at least two, three or more cutters in sequence, spaced apart by interstices 12. In this case, with suitable dimensions of the cutters 3, 3', 3", the notches 303 and the interstices 12 may be disposed according to a predetermined distribution, preferably in such a way as to form predetermined breaking lines with links of material substantially equidistant from each other, the whole preventing the cutters 3, 3', 3" from having angular sizes which are either too large or too small.

In this way it is possible to obtain relatively stronger links of material which still provide a connection between the two parts separated by the predetermined tearing or breaking line and which are provided in a sufficient quantity to permit the easy breaking or tearing apart of the two parts of the piece, these links of material being formed by the interstices 15 between the cutters 3, 3', 3" and being distributed uniformly between further relatively weaker links of material. These offer a lower resistance to tearing, but since they are less stressed because of the presence of the stronger links they provide a further connection of the parts of the piece of material separated by the predetermined tearing or breaking line, thus reducing the length of the cuts.

This may be important when, in cigarette packing machines in particular, the pieces of material consist of tinfoil slips which, after separation from a continuous strip and the execution of the predetermined tearing or breaking lines which delimit an area of the slip coinciding with the openable front face of the rigid pack, have to be subjected to further folding phases executed in an extremely fast and relatively complex way.

Naturally, the invention is not limited to the embodiments described and illustrated herein, but may be greatly varied and modified, particularly as regards construction, without departure from the guiding principle disclosed above and claimed below.

I claim:

1. A device for making cuts in a piece of thin material, said device comprising:

a cutter carrying drum having a periphery and rotating about a drum axis in a direction of advance of the thin material, the drum axis defining a radial direction;

a peripheral cutter including a cutting edge which is curved about an axis coaxial with the drum axis;

a cutter mounting base including a fixing base removably attached to said cutter carrying drum, a radially outer portion attached to said peripheral cutter, said cutting edge orientated parallel to the direction of advance and projecting radially beyond the periphery of said cutter carrying drum, and an elastic support portion intermediate said common fixing base and said radially outer portion, said recess providing (a) a radial elasticity to said peripheral cutter relative to the drum axis, and (b) an oscillatory elasticity to said peripheral cutter relative to an oscillatory axis parallel to the drum axis, said elastic support portion including (a) first and second lateral sides extending radially between said fixing base and said radially outer portion (b) a first slit having two opposite closed ends, said first slit disposed between said first and second lateral sides, and disposed adjacent to a radially outer position of said elastic support portion;

(c) a second slit having two opposite closed ends, said second slit spaced radially inward from said first slit, said second slit disposed between said first and second lateral sides, and disposed adjacent to a radially inner position of said elastic support portion; and (d) two laterally aligned third slits spaced intermediate said first slit and said second slit, said third slits each having an open end, which extends into a respective one of said first and second lateral sides of said elastic support portion, and said third slits having an opposite closed end being laterally adjacent but spaced from the other closed end; and a cutting bed drum having a periphery and rotating in the direction of advance and which interacts with the periphery of said cutter carrying drum.

2. A device for making cuts as claimed in claim 1, wherein the first, second and third slits are rectilinear, parallel to one another, parallel to a tangent to a median point of said cutting edge, and radially equidistant from any adjacent the slit.

3. A device for making cuts as claimed in claim 1:

wherein said closed ends of said second slit have a radial width greater than a radial width of an intermediate portion of said second slit;

wherein the closed ends of said third slits have a radial width greater than a radial width of said open end of an associated said third slits; and wherein said closed ends of said first slit have a radial width greater than a radial width of an intermediate portion of said first slit.

4. A device for making cuts as claimed in claim 1:

wherein the second and first slits each have a lengths, and wherein a lateral dimension between said closed ends of said second slits is smaller than the lateral dimensions of the second and first slits.

5. A device for making cuts as claimed in claim 1, wherein lengths of the second and first slits are equal.

6. A device for making cuts as claimed in claim 1, wherein said second slits each have an equal lateral length.

7. A device for making cuts as claimed in claim 6, wherein a length between the closed ends of said third slits is less than the length of each second slit.

8. A device for making cuts as claimed in claim 1, wherein the oscillatory axis passes through a center of an intermediate portion of said third slits.

9. A device for making cuts as claimed in claim 8, wherein said peripheral cutter includes an inner radial edge opposite to said cutting edge, said inner radial edge being radially outward from the oscillatory axis.

10. A device for making cuts as claimed in claim 4, wherein the length of the intermediate portion is less than half of the lengths of the second and first slits.

11. A device for making cuts as claimed in claim 5, wherein each length of the second and first slits is about equal to a sum of a length of both of said third slits.

12. A device for making cuts as claimed in claim 1:

wherein said cutter carrying drum includes a facing surface perpendicular to the drum axis;

wherein said fixing base of said cutter mounting base includes oppositely located end areas; and said device further including an attaching means for attaching said end areas of said fixing base to said facing surface of said cutter carrying drum.

13. A device for making cuts as claimed in claim 12:

wherein said facing surface of said cutter carrying drum terminates inwardly at an annular ridge coaxial with the drum axis; and wherein said fixing base is an annular segment coaxial with said annular ridge.

14. A device for making cuts as claimed in claim 13, wherein said fixing base includes an adjustment means for adjusting a radial position of said fixing base and hence of said cutting edge of said peripheral cutter.

15. A device for making cuts as claimed in claim 1:

said device further including an additional said peripheral cutter having a cutting edge aligned in the direction of advance; and an additional elastic support portion and an additional radially outer portion, said additional elastic support portion intermediate said fixing base and said additional radially outer portion, and said additional peripheral cutter being attached to said additional radially outer portion.

16. A device for making cuts as claimed in claim 15, wherein said elastic support portion and said additional elastic support portion are connected to a singular said fixing base, and said radially outer portion and said additional radially outer portion are separate from one another.

17. A device for making cuts as claimed in claim 16, wherein adjacent cutting edges of said peripheral cutter and said additional peripheral cutter are laterally separated from one another by an interstice.

18. A device for making cuts as claimed in claim 17, wherein each said cutting edge includes a notch.

19. A device for making cuts as claimed in claim 18, wherein each said interstice has a circumferential distance greater than a circumferential distance of each said notches.

* * * * *